US005762205A

United States Patent [19]

Davitz

[11] Patent Number: 5,762,205

[45] Date of Patent: Jun. 9, 1998

[54] SELF-MASKING, EASILY RECONFIGURABLE SUPPORT RACK FOR FINISHING SYSTEMS

[75] Inventor: Walter E. Davitz, New Albany, Ohio

[73] Assignee: Production Plus Corporation, Columbus, Ohio

[21] Appl. No.: 823,700

[22] Filed: Mar. 25, 1997

[51] Int. Cl.[6] ..... A47F 7/00

[52] U.S. Cl. ..... 211/13; 211/117; 211/118

[58] Field of Search ..... 211/113, 119, 211/117, 118

[56] References Cited

U.S. PATENT DOCUMENTS

| | | | |
|---|---|---|---|
| 3,484,361 | 12/1969 | Sperry | 211/113 X |
| 4,217,853 | 8/1980 | Davitz . | |
| 4,243,146 | 1/1981 | Davitz . | |
| 5,020,677 | 6/1991 | Wirth et al. | 211/113 |
| 5,531,334 | 7/1996 | Forby | 211/119 |

*Primary Examiner*—Alvin C. Chin-Shue
*Assistant Examiner*—Sarah Purol
*Attorney, Agent, or Firm*—Frank H. Foster; Kremblas, Foster, Millard & Pollick

[57] ABSTRACT

An electrically conductive support rack comprising a frame for supporting a plurality of hooks on which workpieces are hung for being transported through a finishing system. A pair of vertical channel beams support a plurality of removable, horizontal crossbars by means of a plurality of support members which are removably mounted to the vertical channel beams. Each support member comprises a resilient wire having an upper hook portion, removably engaging small crossbeams in the vertical channel beams, the wire extending laterally out from the vertical channel beam and then turning downwardly and back into the channel beam to seat resiliently against the top of a second crossbeam of the channel beam. A connector structure, including a brace member, rigidly holds the vertical channel beams transversely to an upper, horizontal crossbar.

11 Claims, 4 Drawing Sheets

SELF-MASKING, EASILY RECONFIGURABLE SUPPORT RACK FOR FINISHING SYSTEMS

TECHNICAL FIELD

This invention relates generally to finishing support racks commonly referred to as gang hangers or hook racks for supporting workpieces on a conveyor which transports the workpieces through a finishing system for cleaning, preparing or coating the workpieces. More particularly, the invention relates to a metal support rack which maintains a highly conductive electrical connection to all portions of the support rack after the support rack components are disassembled and reassembled in a different configuration without requiring stripping or masking.

BACKGROUND ART

Finishing support racks usually have several vertically stacked, horizontal rows or tiers of protruding, article engaging hooks upon which workers hang workpieces for surface finishing. The hooks are connected to vertically spaced, horizontal crossbars which in turn are connected at their opposite ends to vertical side bars.

Industrial finishing systems typically include a conveyor from which a series of such support racks are suspended. A large number of workpieces, such as component parts, are mounted on the hooks for transportation through a finishing system. Most finishing systems have a series of stations at which the workpieces may be sequentially treated by applying one or more materials for cleaning, rinsing, surface preparation, drying, coating and baking the workpieces. For example, liquid or solid charged particles in an electrostatic system are sprayed onto the workpieces at a coating station, such as a paint spray booth. In order for the charged particles to be attracted to the parts, it is necessary that a conductive path be maintained from the conveyor through the support rack to the part.

Most finishing systems are used to finish a large number of identical parts and when that job is completed, a new job is begun in which a large number of identical parts which are different from the preceding parts are then finished. This sequence of new jobs continues indefinitely. Since different parts come in different sizes and differing support requirements, it is necessary to either utilize a different support rack for each job or to disassemble and reassemble the support racks into a different configuration to accommodate the next job and its next set of parts to be finished.

Although some finishing systems utilize different sets of permanently configured support racks, racks which may be disassembled and reconfigured can be more cost effective if they can be reconfigured without excessive labor costs and will operate properly. Such racks permit many diverse and different parts to be finished, yet require the investment in only one set of racks.

However, the use of a single, changeable set of racks creates an inherent problem resulting from the fact that the finishing material is coated not only on the parts, but also on the racks during the finishing process. Paint or other coating material ordinarily has a high electrical resistance so that when a rack which has a material coated upon it is disassembled and reassembled, the coating often prevents electrical contact between the component parts of the rack when the component parts are remounted at a new location. The coating also can mechanically bond the component parts and hinder the disassembly and mechanically interfere with reassembly in a different configuration.

One prior art solution to this problem has been a combination of masking selected portions of the rack, or chemically stripping the coating from the rack before the racks are reassembled in a new configuration. This is particularly a problem in the prior art support racks in which a metal hook is simply suspended from a horizontal rod and the horizontal rods are connected to vertical side bars by means of pins inserted through cooperating holes.

My previous patents, Pat. Nos. 4,217,853 and 4,243,146 solved the problem of connecting the part supporting hooks to horizontal bars in a manner which both holds the hooks immobile and in a fixed horizontal spacing and prevents the coating material from being sprayed upon the portions of the interconnected hooks and horizontal crossbars which provide electrical contact. That allows the hooks to be removed and repositioned in new locations without any deterioration of the electrical conduction between the hooks and the horizontal, hook-supporting crossbars of the rack.

It is an object and feature of the present invention to provide a finishing support rack which is so easily disassembled and reassembled into a new configuration that it can be reconfigured while the rack is still suspended from the conveyor without requiring any stripping of the previously applied finishing material or any masking of the rack and which still maintains a highly conductive metal to metal contact throughout the rack while maintaining physical strength, even though the rack has been previously exposed to and coated with the finishing material.

It is an object and feature of the present invention to provide a rack which is self-masking, is relatively strong and rigid so that it will retain its assembled shape, has no narrow or close tolerance fits which can bridge with paint and prevent disassembly, and yet maintains its strength and rigid attachment so the parts do not pivot or slide with respect to each other.

In particular, it is an object of the present invention to permit the easy change of the vertical spacing for parts of different length by allowing the horizontal crossbars to be moved up and down to new vertical locations and spacings while maintaining good electrical contact without the need for stripping or specially applied masking.

BRIEF DISCLOSURE OF INVENTION

The invention is an electrically conductive support rack comprising a frame for supporting a plurality of hooks mounted to the frame and on which workpieces are hung for transporting the workpieces through a finishing system.

The rack has a horizontal, upper crossbar and a pair of vertical channel beams forming sidebars extending downwardly from near the opposite ends of the crossbar. Each channel beam comprises a pair of side panels joined by a cross web and has a series of crossbeams spaced along the channel beam and extending between the side panels and spaced from the cross web. A plurality of support members are removably mounted to the vertical channel beams for supporting the removable, horizontal crossbars. Each support member comprises a resilient wire, having an upper hook portion removably engaging and extending partially around a first crossbeam, at least between the first crossbeam and the cross web of a vertical channel beam. The upper hook portion extends sufficiently far around the crossbeam to prevent the upper hook portion from being pulled out of the channel. The wire extends from the hook portion, out of the channel of the vertical channel beam, and then turns downwardly and back into the channel beam at the wire's lower end and resiliently seats against the top of a second crossbeam of the vertical channel beam.

Preferably, the upper, horizontal crossbar is rigidly connected to the vertical channel beams by a single fastener at each end of the horizontal crossbar and a brace member at the opposite ends of the crossbar retains the vertical channel members against pivotal movement about the fastener.

BRIEF DESCRIPTION OF DRAWINGS

FIG. 5 is a view in side elevation of the segment of the rack illustrated in FIG. 4.

FIG. 6 is an end view in vertical elevation of the segment illustrated in FIG. 4.

FIG. 7 is a view in horizontal section of the structure illustrated in FIGS. 4–7 taken substantially along the line 7—7 of FIG. 5.

Figure 1:
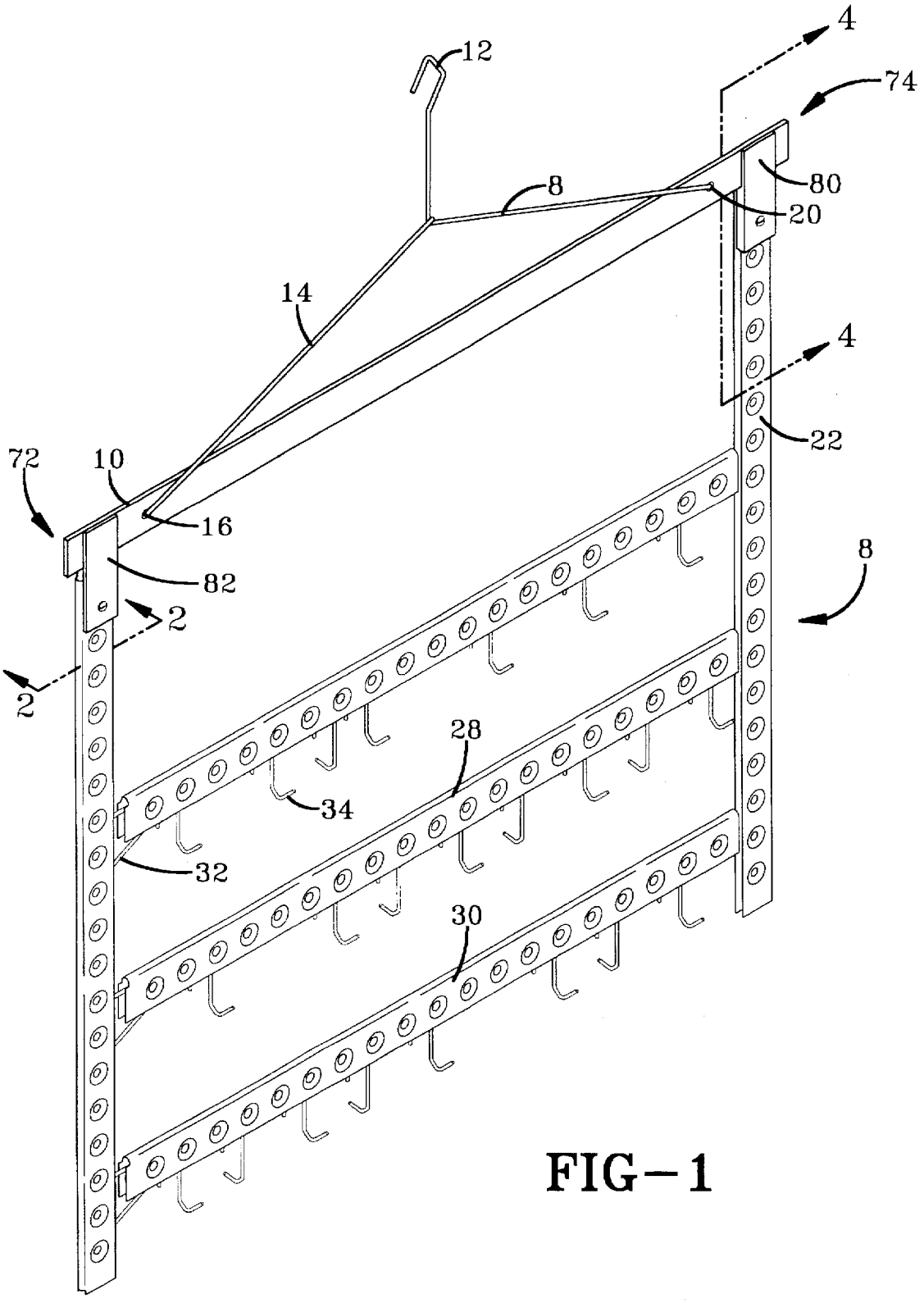
FIG. 1 is a view in perspective of a support rack embodying the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

FIG. 1 illustrates an electrically conductive support rack 8 embodying the present invention. The support rack 8 has a horizontal, upper crossbar 10. A conveyor hook 12 for connection to the conveyor extends centrally upwardly from the upper crossbar 10 and has a first segment of wire having the conveyor hook portion 12 and an oblique brace portion 14 bent to extend through a hole 16 in the upper crossbar 10. A second brace member 18 is similarly fixed to a hole 20 and hooks obliquely around the first brace member portion 14.

A pair of vertical channel beams 22 and 24 extend downwardly from near the opposite ends of the crossbar 10. A plurality of vertically spaced, removable, horizontal crossbars 26, 28 and 30 are connected between the vertical channel beams 22 and 24. Each removable, horizontal crossbar is supported on the vertical channel beams 22 and 24 by a removable, bent wire, support member, such as support member 32, engaging each of its ends. The vertical channel beams 22 and 24 may be of any desired length and each bent wire support member, such as support member 32, may be positioned at any selected position along the vertical channel beams 22 and 24 so that the support rack 8 can provide both a desired quantity of horizontal crossbars and the desired spacing between them. Hooks 34 are removably engaged in the removable, horizontal crossbars 26, 28 and 30 and are preferably formed and engaged in the manner illustrated in my Pat. Nos. 4,217,853 and 4,243,146.

Both the vertical channel beams 22 and 24 and the horizontal crossbars 26, 28 and 30 are all formed in the same manner as illustrated in my above-cited two patents, and the disclosures in those two patents are herein incorporated by reference. Additionally, a hook engaging, horizontal crossbar 31 is welded to the underside of the upper crossbar 10 so that hooks can also be suspended from the upper crossbar. It does not need to be moved because there will always be a top at the uppermost position on the support rack.

Figure 2:
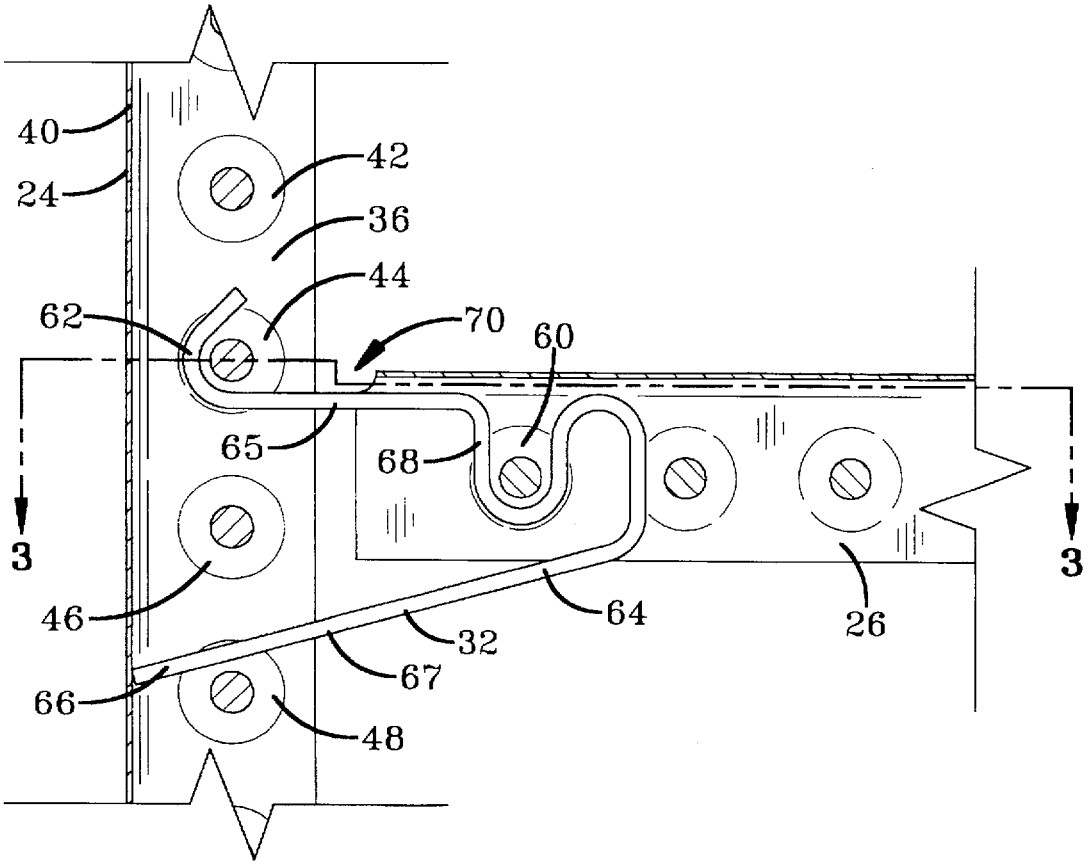
FIG. 2 is a view in vertical section illustrating a preferred support member for supporting removable, horizontal crossbars and taken along the lines 2—2 of FIG. 1.
Figure 3:
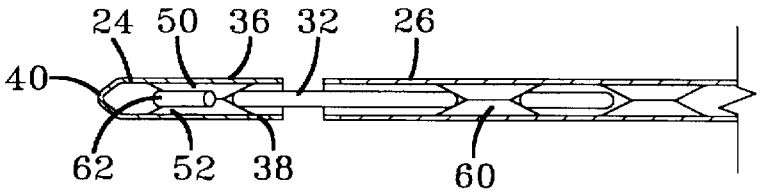
FIG. 3 is a view in horizontal section of the embodiment of FIG. 2 taken substantially along the lines 3—of FIG. 2.
Figure 7:
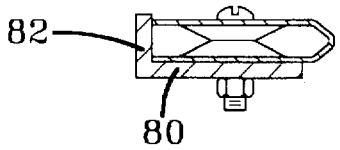
FIGS. 4–7 illustrate a segment or portion of the connecting and bracing structures for rigidly retaining the vertical channel members on the upper, horizonal crossbeam with FIG. 4 being in vertical section taken substantially along the line 4—4 of FIG. 1.
Figure 4:
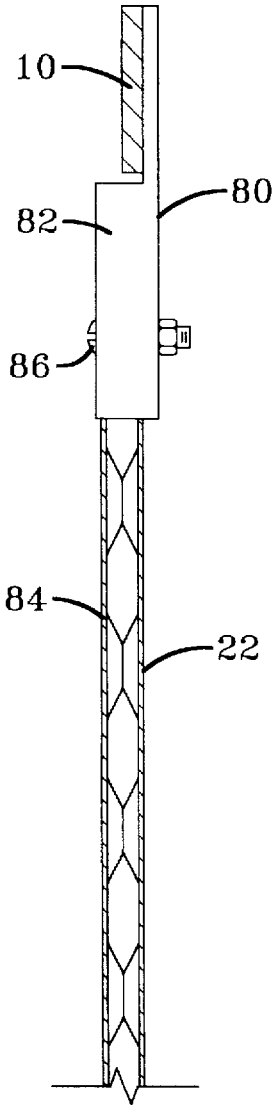
Figure 5:
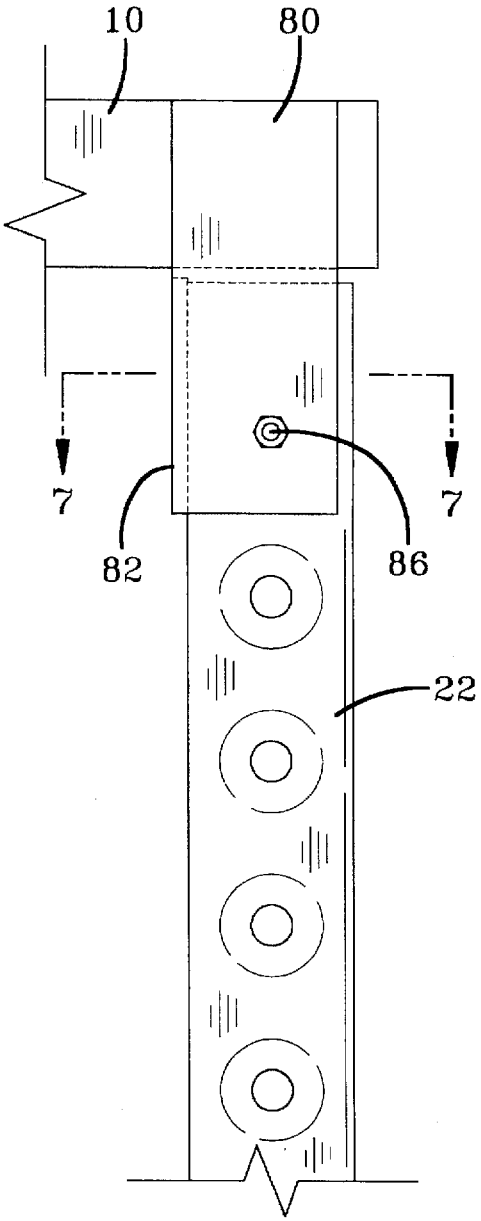
Figure 6:
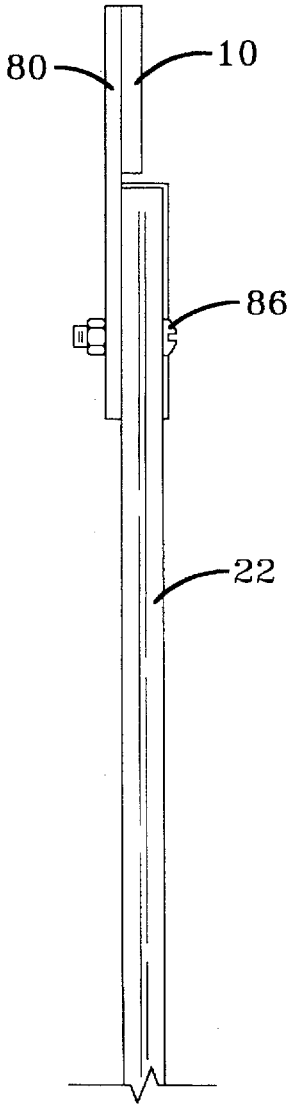

FIGS. 2 and 3 illustrate in more detail the structure of the vertical channel beams 22 and 24, the horizontal crossbars 26, 28 and 30, and the support members, such as support member 32. The channel beam 24 has a pair of side panels 36 and 38, which are joined together by a cross web 40 to define an interior channel. A series of crossbeams 42, 44, 46, and 48 are spaced along the channel beam 24, extend between the side panels 36 and 38, and are spaced from the cross web 40. Although these crossbeams could be formed from pins, bolts, or other structures extending between the side panels 36 and 38, the preferred crossbeams are formed by a pair of opposed, inwardly tapering, frusto-conical projections or bosses, such as projections 50 and 52, which are stamped into the side panels of the vertical channel beams. These frusto-conical projections are preferably spot welded or otherwise connected together to form an annular, bevelled groove.

The bent wire support member 32 engages the crossbeams 44 and 48 of the vertical channel beam 24 and also engages the crossbeam 60 of the removable, horizontal crossbar 26. The support member 32 is formed of a resilient, spring-type wire and has an upper hook portion 62 which removably engages and extends partially around the crossbeam 44. The hook portion 62 extends at least between the crossbeam 44 and the cross web 40 to assure that the upper hook portion 62 cannot be pulled out of the channel of the vertical channel beam 24 by any combination of lateral and downward forces exerted on the support member 32 by the removable crossbeam 26.

The wire of the support member 32 extends from the hook portion 62 laterally out of the channel of vertical channel beam 24 and turns downwardly and back into the vertical channel beam 24 at its lower portion 64. The lower end 66 of the support member 32 resiliently seats against the top of another crossbeam 48 of the vertical channel beam 24. Preferably, the upper, laterally extending portion of the support member 32 is also bent into an upwardly opening loop 68 which engages the crossbeam 60 of the removable, horizontal crossbar 26. The upwardly opening loop 68 supports the removable, horizontal crossbar 26 and prevents it from making any lateral movement with respect to the vertical channel beams within the frame, and yet permits the removable, horizontal crossbar to be removed by a simple, upward lifting force applied manually to it.

The upper leg 65 and the lower leg 67 of the support member 32 are further apart than illustrated in FIG. 2 when the resilient wire support member 32 is in a relaxed state. The support member 32 is simply and easily mounted to a selected position on the vertical channel beam 24 by grasping it in one hand and squeezing the upper leg 65 and the lower leg 67 closer together than illustrated in FIG. 2, and then inserting the upper hook portion 62 into the channel of the vertical channel beam 24 below the crossbeam 44 and raising it into engagement with the crossbeam 44, as illustrated in FIG. 2. At the same time, the lower leg 66 is inserted into the channel of the vertical channel beam 24 between the crossbeams 46 and 48 and then released until it seats against the top of the crossbeam 48. The resilient spring action retains the support member 32 in position. Although the lower end 66 of the support member 32 can be bent or formed to have a hook portion, I have found that such a contour is usually unnecessary. Preferably the lower end 66 of the support member 32 extends into direct contact with the cross web 40 because the sharp end of the wire makes a particularly good electrical contact with the cross web. Additionally, the heavier the load applied to the support members by the workpieces through the horizontal, removable crossbeams, the more the lower end 66 of the support member 32 is driven into electrical contact with the cross web 40.

One advantage of this structure is that the regions of metal to metal electrical contact between the support member 32 and the vertical channel members 22 and 24 are within the channels and are therefore masked by the side panels. Furthermore, the opening into the channel of each vertical channel beam faces perpendicularly to the plane of the rack, and therefore perpendicularly to the direction of application of a spray to the workpieces. Consequently, the interfacing areas of electrical contact within the vertical channel beams, within the removable, horizontal crossbars, and of the support members are all masked by the side panels of the channel members. As a result of the lateral orientation of the channels, very little coating material enters the channel and therefore preserves the electrically contacting surfaces of the rack components for reuse for a long period of time in a manner which maintains a good metal to metal electrical contact. The result is that the support members may be easily removed from one location along a vertical channel beam and reinserted at another location without the interference of any paint film interposed between the contacting metal surfaces, and consequently allowing a high conductance connection.

Preferably, a gap, such as gap 70, is provided between each end of each horizontal crossbar and its neighboring vertical channel beam. This gap is preferably at least ¼ inch and prevents the paint or other material applied to the work pieces from building up and bridging between the vertical channel beams and the removable, horizontal crossbars. Consequently, there are no such bridges interfering with the physical disassembly or reassembly of the support rack.

The removable, horizontal crossbar is not only easily removed and placed somewhere else, but also permits the substitution of an entirely different horizontal crossbar.

For a similar reason it is preferred that the wire utilized to form the support members has an outside diameter which is substantially less than the interior distance between the side panels of the channel beams. This relationship provides a substantial gap between the support members and the side panels of the vertical channel beams to prevent a similar bridging by the coating material and consequent impediment to assembly and reassembly of the support rack. Preferably, the wire has a diameter of substantially 0.090 inch, the distance between the side panels of the channel beams is substantially 3/16th inch and the channel beams have a depth of substantially 1 3/16 inch.

FIGS. 4–7 illustrate the connector structures 72 and 74 for connecting the upper horizontal crossbar 10 to each of the vertical channel beams 22 and 24. A connector structure is provided at each opposite end of the upper horizontal crossbar 10 and includes a brace member 80 at one end and a brace member 82 at the opposite end. The two brace member structures are mirror images so only one is described.

A brace member 80 is preferably welded at 90° to the upper horizontal crossbar 10, but can be inclined at any other angle transversely of the upper horizontal crossbar 10. The brace member 80 has a flange 82 for seating against a lateral edge 84 of the vertical channel beam 22. Aligned holes are provided through the brace member 80 and the vertical channel beam 22 for insertion of a fastener, such as a bolt 86. The flange 82 retains the vertical channel beam 22 against pivotal movement about the fastener.

This arrangement retains the vertical channel beams and therefore the workpieces supported on the removable, horizontal crossbars in a fixed position on the support rack. Additionally, it also permits the support rack to be shipped to a customer in a disassembled form, thus minimizing shipping costs. This connector structure not only holds the vertical channel beams in rigid relationship to the upper horizontal crossbar, but does so with a single fastener. The use of a single fastener facilitates the simple removal of a single fastener in the event the entire support rack must be disassembled and permits it to be easily and quickly reassembled inexpensively utilizing a single fastener at each end of the upper crossbar. The fastener can be simply ground off with a grindstone and inexpensively replaced.

Figure 8:
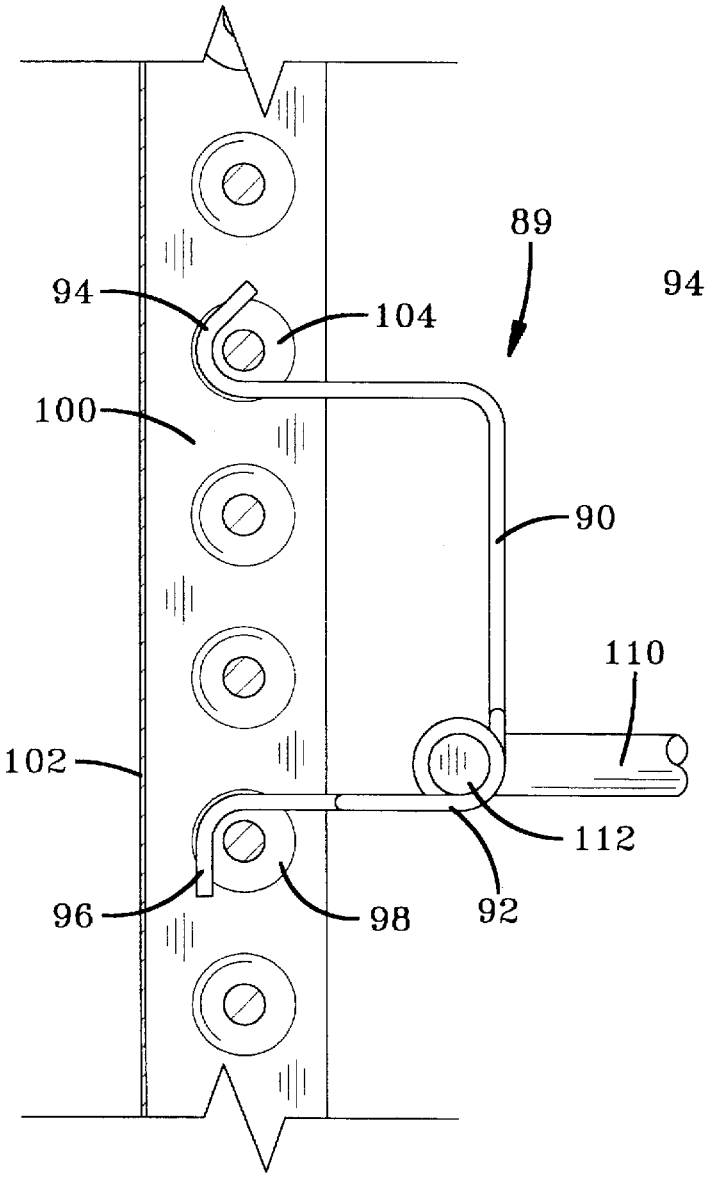
FIG. 8 is a view in vertical section similar to the view of FIG. 2, but showing an alternative support member structure.
Figure 9:
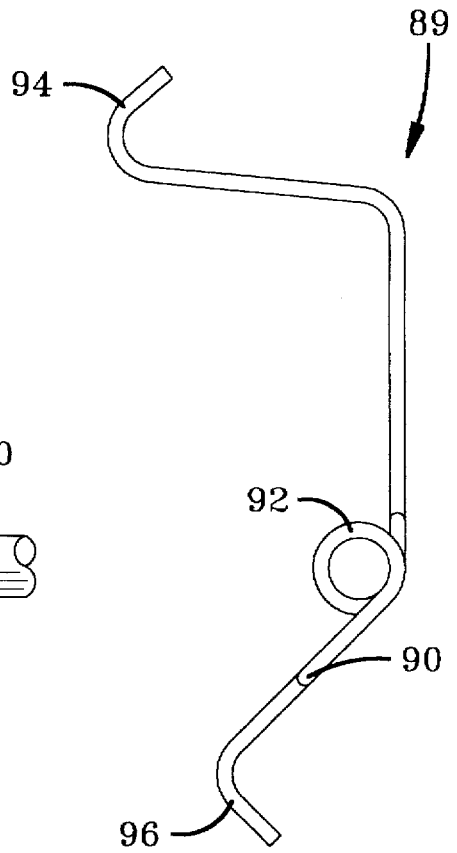
FIG. 9 is a view in perspective of the support member illustrated in FIG. 8 shown in a relaxed position.

A variety of alternative support member structures for removable attachment to the vertical channel beams are possible. One alternative support member 89 is illustrated in FIGS. 8 and 9. This support member 89 comprises a wire 90 having a spring coil 92 integrally formed and interposed between the upper hook portion 94 and the lower end 96, which resiliently engages a crossbeam 98 of a vertical channel beam 100. The lower end 96 of the support member 89 has a downturned hook portion for extending between the crossbeam 98 and the cross web 102. FIG. 9 illustrates the support member 89 in its relaxed state with its lower end 96 pivoted further away from the upper hook portion 94 than illustrated in FIG. 8. The support member 89 is inserted on the vertical channel beam 100 by grasping the upper and lower ends between the fingers and squeezing them towards each other until the upper hook 94 can pass beneath the crossbeam 104 and the lower, downturned hook 96 can pass above the crossbeam 98. The support member is then relaxed until it seats into the position illustrated in FIG. 8.

One convenient purpose for the support member 90 is to support a horizontal U-shaped rod 110, having each of its end legs bent 90° and inserted in a snug or friction fit within the spring loop 92, such as the end leg 112. This offers increased versatility and is particularly adaptable for spring loading workpieces between vertically spaced, horizontal crossbars.

From the above structures it can be seen that the present invention provides a support rack which can be easily and quickly reconfigured while suspended from the conveyor and is able to maintain a mechanically strong, highly conductive, metal to metal contact without requiring stripping or masking between reconfigurations.

While certain preferred embodiments of the present invention have been disclosed in detail, it is to be understood that various modifications may be adopted without departing from the spirit of the invention or scope of the following claims.

I claim:

1. An electrically conductive support rack comprising a frame for supporting a plurality of hooks mounted to the frame and on which workpieces are hung for transporting the workpieces through a finishing system, said rack, in an operable position, comprising:

(a) a horizontal upper crossbar;

(b) a pair of vertical channel beams extending downwardly from near the opposite ends of the crossbar, each channel beam having a pair of side panels joined by a cross web and a series of crossbeams spaced along the channel beam, extending between the side panels and spaced from the cross web; and c) a plurality of support members removably mounted to the vertical channel beams, each support member comprising a resilient wire having an upper hook portion removably engaging and extending partially around a first crossbeam at least between the first crossbeam and the cross web for preventing the upper hook portion from being pulled out of the channel, the wire extending from the hook portion out of the channel and turned downwardly and back into the channel beam at its lower end and resiliently seating against the top of a second crossbeam of the channel beam.

2. A support rack in accordance with claim 1 wherein each support member extends laterally out of the channel beam from the upper hook portion and has an upwardly opening loop and wherein a removable horizontal crossbar is supported on the support member, the horizontal crossbar being a channel beam having a pair of side panels joined by a cross web and at least a pair of crossbeams near opposite ends of the channel beam, the crossbeams extending between the side panels and spaced from the cross web, and wherein a crossbeam near each end of the horizontal crossbar is received in and supported by the upwardly opening loop of a support member.

3. A support rack in accordance with claim 2 wherein the opposite ends of the removable horizontal crossbar are spaced from the vertical channel beams for preventing material applied to the workpieces from bridging between the vertical channel beams and the removable horizontal crossbars.

4. A support rack in accordance with claim 1 wherein the lower end of each wire extends into contact with the cross web of the vertical channel beams.

5. A support rack in accordance with claim 1 wherein the wire has an outside diameter which is substantially less than the distance between the side panels of the channel beams for preventing bridging of a coating material applied to the workpieces between the wire and the vertical channel beams.

6. A support rack in accordance with claim 5 wherein the wire has a diameter of substantially 0.090 inch, the distance between the side panels of the channel beams is substantially 3/16 inch and the channel beams have a depth of substantially 1 and 3/16 inch.

7. A support rack in accordance with claim 1 wherein a support member further comprises the wire being formed into a spring coil interposed between the upper hook portion and the lower end of the support member.

8. A support rack in accordance with claim 7 where the end of the support member which is turned downwardly and back into the channel beam has a downturned hook portion for extending between a crossbeam and the cross web of the vertical channel member.

9. A support rack in accordance with claim 1 wherein the upper horizontal crossbar has a connector structure near each opposite end, each vertical channel beam has a connector structure at its upper end; and the vertical channel beams are connected to the vertical channel beams at the connector structures by removable fasteners rigidly connecting the channel beams transversely to the upper crossbar.

10. A support rack in accordance with claim 9 wherein the connector structures of the upper horizontal crossbar each comprise a brace member arranged transversely of the upper crossbar and including a flange for seating against a lateral edge of the vertical channel beam and retaining the vertical channel beam against pivotal movement about the fastener.

11. A support rack in accordance with claim 10 wherein each connector structure includes a hole for receipt of the fastener.

* * * * *